US006536393B2

(12) United States Patent
Novak et al.

(10) Patent No.: US 6,536,393 B2
(45) Date of Patent: Mar. 25, 2003

(54) MECHANICAL COMPRESSION AND VACUUM RELEASE

(75) Inventors: Keith A. Novak, Depere, WI (US); James R. Dietz, New Holstein, WI (US); Michael A. Mahy, Fond du Lac, WI (US)

(73) Assignee: Tecumseh Products Company, Tecumseh, MI (US)

( * ) Notice: Subject to any disclaimer, the term of this patent is extended or adjusted under 35 U.S.C. 154(b) by 124 days.

(21) Appl. No.: 09/899,673

(22) Filed: Jul. 5, 2001

(65) Prior Publication Data

US 2002/0033158 A1 Mar. 21, 2002

Related U.S. Application Data

(60) Provisional application No. 60/231,818, filed on Sep. 11, 2000.

(51) Int. Cl.[7] ..... F01L 13/08
(52) U.S. Cl. ..... 123/182.1; 123/90.17
(58) Field of Search ..... 123/182.1, 90.17, 123/90.16

(56) References Cited

U.S. PATENT DOCUMENTS

| | | | | |
|---|---|---|---|---|
| 2,999,491 A | | 9/1961 | Harkness | 123/182 |
| 3,306,276 A | | 2/1967 | Harkness et al. | 123/182 |
| 3,362,390 A | | 1/1968 | Besty | 123/182 |
| 3,395,689 A | | 8/1968 | Kruse | 123/182 |
| RE26,462 E | | 9/1968 | Harkness et al. | 123/182 |
| 3,981,289 A | | 9/1976 | Harkness | 123/182 |
| 4,453,507 A | | 6/1984 | Braun et al. | 123/182 |
| 4,760,833 A | * | 8/1988 | Tatyrek | 123/574 |
| 5,150,674 A | | 9/1992 | Gracyalny | 123/182.1 |
| 5,301,643 A | | 4/1994 | Garcyalny | 123/198 D |
| 5,687,683 A | | 11/1997 | Knoblauch | 123/182.1 |
| 5,809,958 A | | 9/1998 | Gracyalny | 123/182.1 |
| 5,904,124 A | | 5/1999 | Poehlman et al. | 123/179.18 |
| 6,394,054 B1 | * | 5/2002 | Rado et al. | 123/182.1 |

FOREIGN PATENT DOCUMENTS

| | | |
|---|---|---|
| EP | 0 515 183 | 11/1992 |
| GB | 1 243 551 | 8/1971 |
| WO | WO 01/61157 | 8/2001 |

* cited by examiner

*Primary Examiner*—Henry C. Yuen
*Assistant Examiner*—Mahmoud Gimie
(74) *Attorney, Agent, or Firm*—Baker & Daniels

(57) ABSTRACT

An internal combustion engine having a vacuum release mechanism that includes a centrifugally actuated member movably attached to the camshaft and having a vacuum release cam extending therefrom. The vacuum release cam is in lifting engagement with the exhaust valve assembly at crankshaft cranking speeds during a portion of the power stroke to relieve vacuum forces opposing motion of the piston. The vacuum release cam centrifugally pivots out of engagement with the exhaust valve assembly in response to the crankshaft attaining running speeds.

21 Claims, 4 Drawing Sheets

MECHANICAL COMPRESSION AND VACUUM RELEASE

CROSS REFERENCE TO RELATED APPLICATIONS

This application claims the benefit under 35 U.S.C. §119 (e) of U.S. Provisional Patent Application Ser. No. 60/231,818, entitled "MECHANICAL COMPRESSION AND VACUUM RELEASE", filed on Sep. 11, 2000.

BACKGROUND OF THE INVENTION

1. Field of the Invention

This invention generally relates to internal combustion engines, and more particularly to a compression release and vacuum release mechanism for four-stoke cycle engines.

2. Description of the Related Art

Compression release mechanisms for four-stroke cycle engines are well known in the art. Generally, means are provided to hold one of the valves in the combustion chamber of the cylinder head slightly open during the compression stroke while cranking the engine during starting. This action partially relieves the force of compression in the cylinder during starting, so that starting torque requirements of the engine are greatly reduced. When the engine starts and reaches running speeds, the compression release mechanism is rendered inoperable so that the engine may achieve full performance. It is normally advantageous for the compression release mechanism to be associated with the exhaust valve so that the normal flow of the fuel/air mixture into the chamber through the intake valve, and the elimination of spent gases through the exhaust valve is not interrupted, and the normal direction of flow through the chamber is not reversed. Examples of compression release mechanisms for four-stroke engines are shown in U.S. Pat. Nos. 3,381,676; 3,496,922; 3,897,768; 4,453,507; 4,977,868; 5,150,674 and 5,184,586, the disclosures of which are incorporated herein by reference. Although known compression release mechanisms are generally effective for relieving compression in the cylinder during cranking the engine, these mechanisms are typically designed to provide compression relief and do not remedy the significant torque established by vacuum in the combustion chamber during the power stroke.

Presently, conventional four-stoke engines require a significant amount of torque to turn the engine over during the power stroke when combustion is not taking place, because the piston is moving downwardly against a pressure difference due to increasing suction or vacuum in the combustion chamber resulting from the partial discharge of gas from the combustion chamber during the immediately preceding compression stroke. The increase of torque required corresponds to a substantial operator or starter force required to drive the piston downwardly against such pressure difference.

In response to the suction torque, one known combustion engine suggests using a contoured cam lobe which acts to hold the valve open longer between the compression and power strokes. Starting torque was decreased by this mechanism, however compression and accordingly engine power would significantly decrease compared to conventional engines which employ the traditional "pear-shaped" cam lobes. Yet another known mechanism employs a light spring placed on the stem side of the exhaust valve to hold the valve open during start up. However, in such an arrangement, significant intake and exhaust manifold pressures are required to close the exhaust valve and thus longer times and increased user effort is required to start the engine.

It may be seen that torque, due to compression during start-up, is related to the torque due to vacuum during start-up. Specifically, the release of a significant amount of trapped air during the compression stroke, through the mechanical compression release, causes higher vacuum pressure to form in the cylinder. Very little user effort is required to turn the engine over during the compression stroke, however a substantial starting effort is required during the power stroke. Conversely, though, if very little air is released by the mechanical compression release then beneficially the pressure due to vacuum will be less. However, the pressure caused by compression will be high.

Accordingly, it is desired to provide a release mechanism that addresses the significant torque developed by both the compression and power strokes, is effective in operation, and is relatively simple in construction.

SUMMARY OF THE INVENTION

The present invention overcomes the disadvantages of prior internal combustion engines by providing a mechanical compression and vacuum release mechanism which is of simple construction and which significantly reduces the effort required to start the engine. The present compression and vacuum release mechanism includes a centrifugally responsive compression and vacuum release member pivotally mounted to the camshaft, the compression and vacuum release member including compression and vacuum release cams which are in lifting engagement with one of the intake or exhaust valve assemblies of the engine during engine starting to relieve compression and vacuum forces within the combustion chamber and thereby facilitate easier engine starting. After the engine is started and reaches a running speed, the compression and vacuum release member pivots about the camshaft such that the compression and vacuum release cams are disengaged from the lifting engagement with the intake or exhaust valve assemblies for normal engine operation.

In one form thereof, the present invention provides an internal combustion engine, including a cylinder block including a cylinder therein and having a piston reciprocally disposed within the cylinder, the piston operably engaged with a crankshaft; a camshaft in timed driven relationship with the crankshaft; at least one intake valve reciprocally driven by the camshaft; at least one exhaust valve assembly reciprocally driven by the camshaft; and a vacuum release mechanism, including a vacuum release member attached to the camshaft and centrifugally moveable between first and second positions, the vacuum release member including a vacuum release cam extending therefrom, the vacuum release cam in lifting engagement with one of the valve assemblies in the first position during a portion of a power stroke of the piston to relieve vacuum forces opposing the power stroke, the vacuum release cam disposed out of engagement with the one of the valve assemblies in the second position.

In another form thereof, the present invention provides an internal combustion engine, including a cylinder block including a cylinder therein and having a piston reciprocally disposed within the cylinder, the piston operably engaged with a crankshaft; a camshaft in timed driven relationship with the crankshaft; at least one intake valve assembly reciprocally driven by the camshaft; at least one exhaust valve assembly reciprocally driven by the camshaft; and a compression and vacuum release mechanism, including a compression and vacuum release member attached to the camshaft and centrifugally moveable between first and second positions, the compression and vacuum release member including a compression release cam and a vacuum release cam extending therefrom, the compression and vacuum release cams respectively in lifting engagement with one of the valve assemblies in said first position during a portion of a compression and a portion of a power stroke of the piston to relieve compression and vacuum forces respectively opposing the compression and the power strokes, the compression and vacuum release cams disposed out of engagement with the one of said valve assemblies in the second position.

In a further form thereof, an internal combustion engine, including a cylinder block including a cylinder therein and having a piston reciprocally disposed within the cylinder, the piston operably engaged with a crankshaft; a camshaft in timed driven relationship with the crankshaft; at least one intake valve assembly reciprocally driven by the camshaft; at least one exhaust valve assembly reciprocally driven by the camshaft; and a compression and vacuum release mechanism, including a centrifugally actuated common yoke member moveably attached to the camshaft between a first position corresponding to a cranking speed of the engine and a second position corresponding to a running speed of the engine; a compression release cam extending from the yoke member and in lifting engagement with one of the valve assemblies in the second position during a portion of a compression stroke of the piston to relieve compressive forces opposing the compression stroke; and a vacuum release cam extending from the yoke member and in lifting engagement with the one of the valve assemblies in the first position during a portion of a power stroke of the piston to relieve vacuum forces opposing the power stroke; the compression and vacuum release cams disposed out of lifting engagement with the one of the valve assemblies in the second position.

BRIEF DESCRIPTION OF THE DRAWINGS

The above mentioned and other features and objects of this invention will become more apparent and the invention itself will be better understood by reference to the following description of embodiments of the invention taken in conjunction with the accompanying drawings, wherein.

Figure 1:
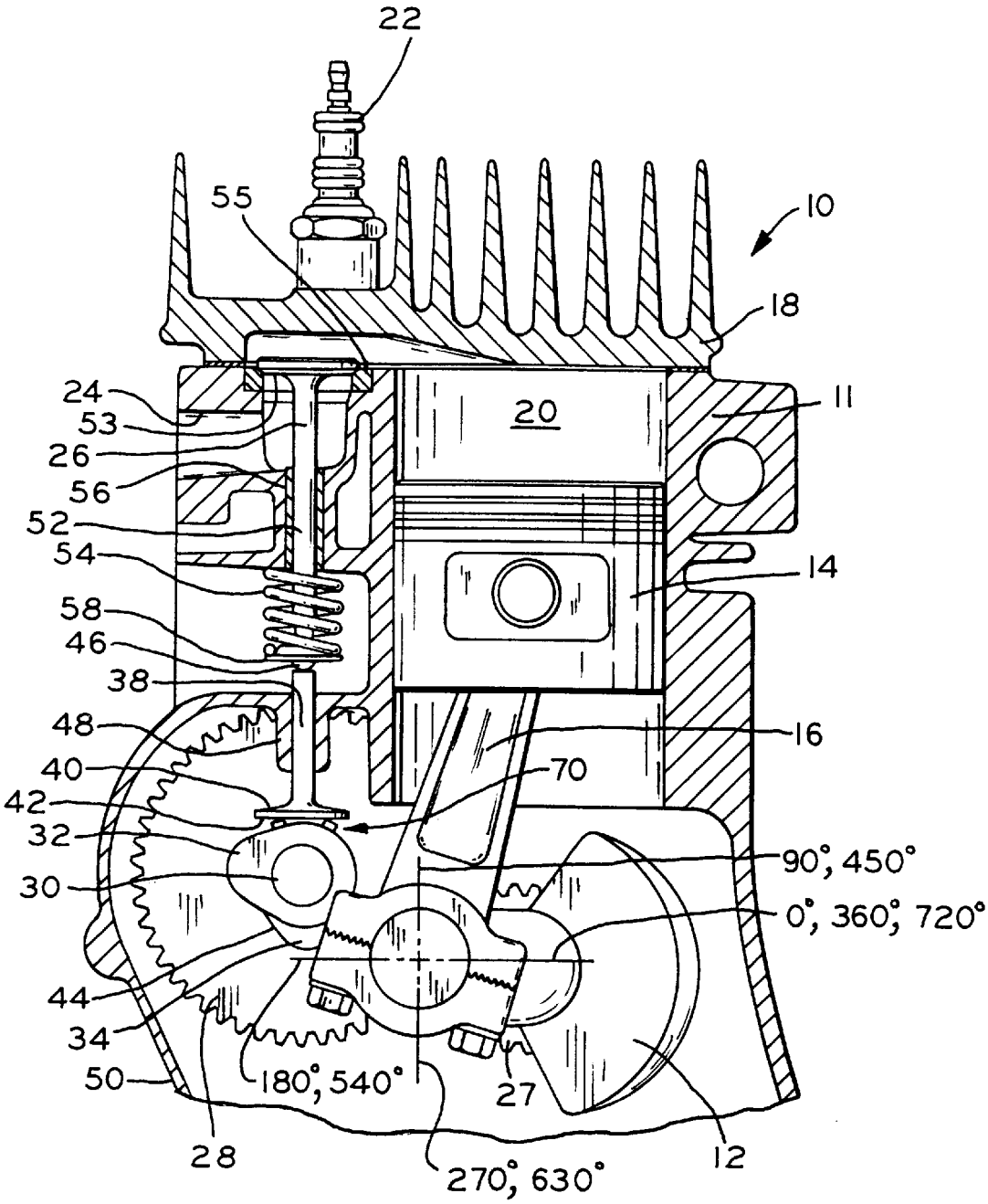
FIG. 1 is a partial vertical sectional view of a single cylinder four-stroke internal combustion engine that incorporates a mechanical compression and vacuum release device in accordance with the principles of the present invention.

Corresponding reference characters indicate corresponding parts throughout the several views. Although the drawings represent several embodiments of the present invention, the drawings are not necessarily to scale and certain features may be exaggerated in order to better illustrate and explain the present invention.

DETAILED DESCRIPTION

Referring now the drawings and particularly to FIG. 1, there is shown a vertical crankshaft, single cylinder, four-stroke internal combustion engine 10 including a compression and vacuum release mechanism according to one embodiment of the present invention. As is customary, engine 10 includes cylinder block 11, crankshaft 12 and piston 14, the piston being operatively connected to crankshaft 12 through connecting rod 16. Piston 14 coacts with cylinder block 11 and cylinder head 18 to define combustion chamber 20. Spark plug 22 secured in cylinder head 18 ignites the fuel/air mixture after it has been drawn into combustion chamber 20 through intake valve 21 (FIG. 2) during the intake stroke and has been compressed during the compression stroke of piston 14. The spark is normally timed to ignite the fuel/air mixture just before piston 14 completes its ascent on the compression stroke. The fuel/air mixture is drawn into combustion chamber 20 from the carburetor of the engine through an intake passage controlled by a conventional intake valve (not shown), and the products of combustion are expelled from the cylinder during the exhaust stroke through exhaust port 24 controlled by poppet-type exhaust valve 26. Although either valve 21, 26 may be opened to vent compression and vacuum during start-up, it is recognized that preferably exhaust valve 26 functions as the compression and vacuum release valve in a manner to be discussed hereinafter.

Other conventional parts of the valve operating mechanism, or valve assembly, include timing gear 27 mounted on crankshaft 12 for rotation therewith, and camshaft gear 28 mounted on camshaft 30 and rotatably driven by timing gear 27 to thereby rotate camshaft 30 at one-half crankshaft speed. Camshaft 30 comprises conventional pear-shaped intake and exhaust camshaft lobes 32 and 34, respectively, (FIGS. 1 and 2) which rotate with camshaft 30 to impart reciprocating motion to the intake and exhaust valves 21, 26 via tappets or cam followers 36 and 38, respectively. Although FIGS. 1 and 2 illustrate the compression and vacuum release mechanism in a side valve engine, this is but one engine type, and it is envisioned that the compression and vacuum release mechanism is amenable to other engine types, such as OHV and OHC engines of a vertical or horizontal crankshaft type, for example.

Figure 2:
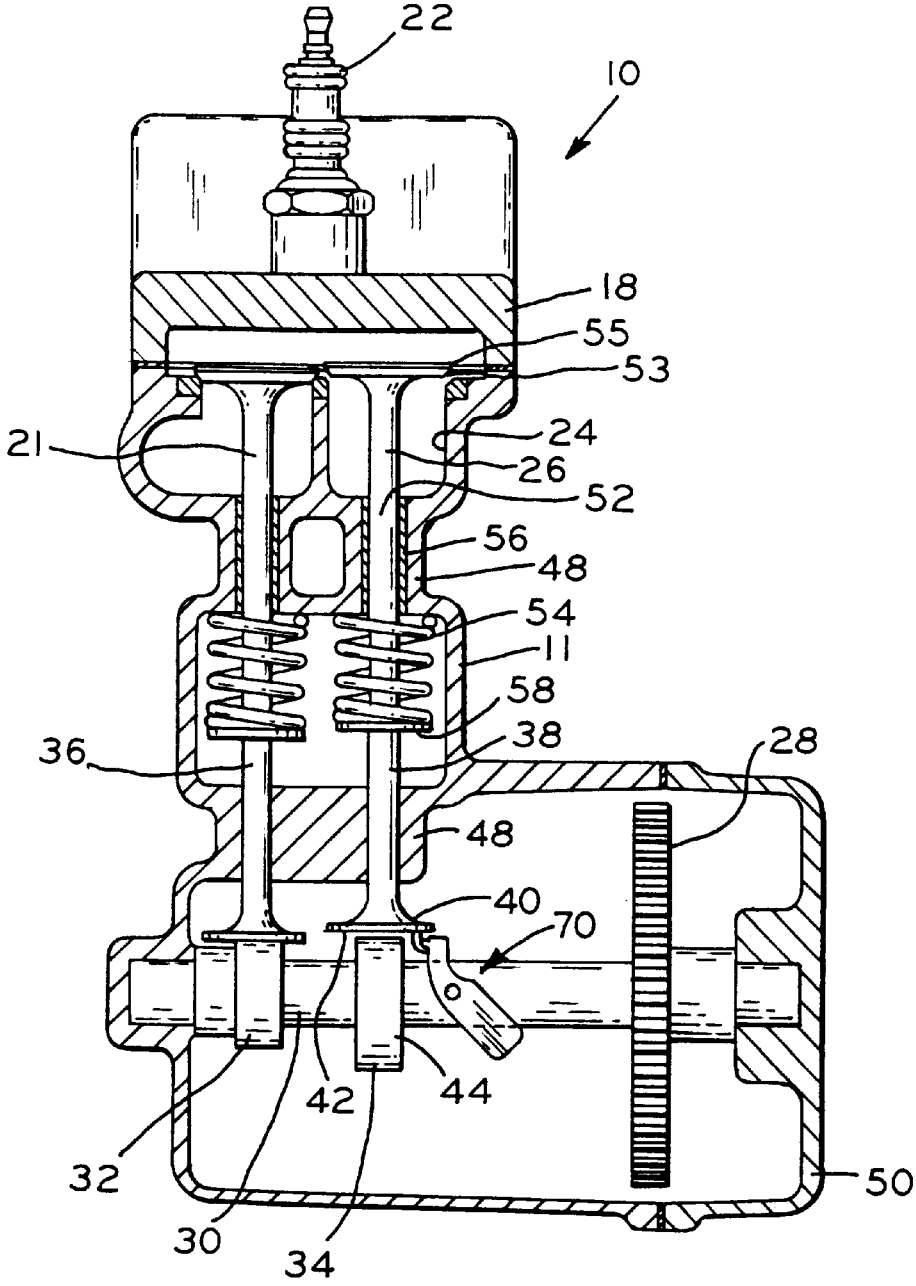
FIG. 2 is a sectional view of the engine of FIG. 1 showing the compression and vacuum release in the start position.

Referring to FIG. 2, intake lobe 32 is the outboard lobe furthest removed relative to camshaft gear 28, and exhaust lobe 34 is inboard from camshaft gear 28 and lobe 32. The exhaust valve train is shown in FIG. 1 and includes cam follower 38 having face 42 adapted to bear tangentially against, and remain in a continuous abutting relationship with, peripheral surface 44 of exhaust camshaft lobe 34.

Referring to FIG. 1, cam follower 38 slides in guide boss 48 of crankcase 50, and its upper end pushes against tip 46 of valve 26. In operation, cam follower 38 lifts stem 52 of exhaust valve 26 which lifts face 53 from valve seat 55. Valve spring 54 encircles stem 52 between valve guide 56 and spring retainer 58. Spring 54 biases valve 26 closed and also biases cam follower 38 into tracking contact with exhaust lobe 34. Although the valve train or valve assembly shown in FIGS. 1 and 2 includes a camshaft having lobes which directly actuate the intake and exhaust valves, other engines in which the present invention may be used may include different valve trains or valve assemblies, such as, for example, an overhead camshaft driven from the crankshaft via linkage and including lobes for opening and closing the intake and exhaust valves; a camshaft driven from the crankshaft and including lobes for actuating push rods connected to rocker arms which in turn open and close the intake and exhaust valves; or a camshaft having a single cam lobe actuating rocker arms which in turn open and close the intake or exhaust valves. Other valve train or valve assemblies are also possible in engines in which the present invention may be used.

To aid in starting engine 10, mechanical compression and vacuum release 70 is provided and will be described below. While device 70 is in its inoperative position (FIG. 4B), which is designated as the "run" position of the engine, the rotation of outboard lobe 34 with camshaft 30 at "running speed" causes normal operation of valve 26, so that valve 26 opens and closes in timed and periodic relation with the travel of piston 14 according to conventional engine timing practice. Thus, exhaust lobe 34 is adapted to open valve 26 near the end of the power stroke and to hold the same open during ascent of the piston on the exhaust stroke until the piston has moved slightly past top dead center. As camshaft lobe 34 continues to rotate, spring 58 forces cam follower 38 downwardly and valve 26 is reseated. Valve 26 is held closed during the ensuing intake, compression and power strokes. Intake camshaft lobe 32 is likewise of conventional fixed configuration to control the intake valve such that it completely closes shortly after the piston begins its compression stroke and remains closed throughout the subsequent power and exhaust strokes, and reopening to admit the fuel mixture on the intake stroke.

Since in a conventional engine the intake and exhaust valves are normally closed for the major portion of the power stroke, cranking of the engine is impeded because the piston must pull against a vacuum in the combustion chamber. Such vacuum may be created in the combustion chamber by the operation of a conventional compression release mechanism during engine starting. However, by incorporating the compression and vacuum release mechanism of the present invention, compression and vacuum relief is automatically obtained at cranking speeds to greatly reduce cranking effort and thereby facilitate starting. Moreover, a conventional engine need not be physically altered to effect compression and vacuum release with the mechanism of the present invention incorporated therein. The compression and vacuum release mechanism is responsive to engine speed such that it is automatically rendered inoperative at engine running speeds to prevent compression loss or loss of efficiency of the engine when it is running under its own power.

Figure 3:
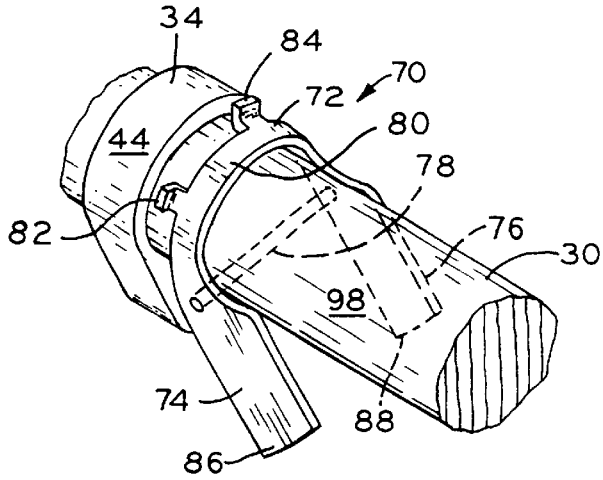
FIG. 3 is a perspective view of a first embodiment compression and vacuum release assembly engaged with a camshaft.
Figure 4A:
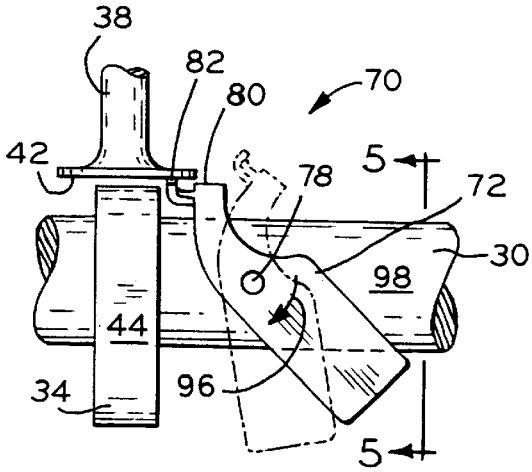
FIG. 4A is a side view of the compression and vacuum release assembly of FIG. 3, showing the assembly in the start position and showing the run position in phantom.
Figure 4B:
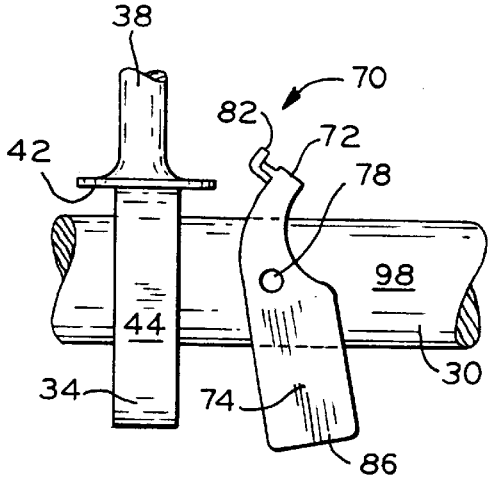
FIG. 4B is a side view of the compression and vacuum release assembly of FIG. 3, showing the assembly in the run position.
Figure 5:
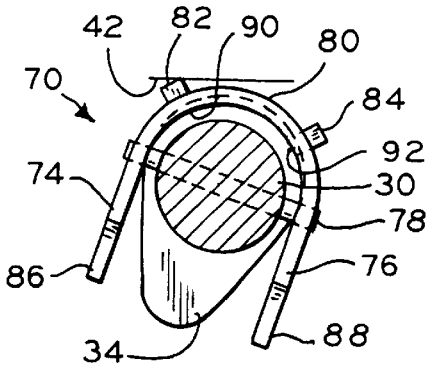
FIG. 5 is a sectional view of the view compression and vacuum release assembly of FIG. 4A taken along line 5—5 of FIG. 4A.

Referring to FIGS. 3–5, a first embodiment of a compression and vacuum release mechanism 70 of the present invention is shown. Compression and vacuum release mechanism 70 includes pivotable yoke member 72, having a pair of legs 74, 76 that straddle camshaft 30. Legs 74, 76 are pivotally connected to the camshaft by means of pin 78 and connected together by arcuate saddle portion 80 of yoke member 72. Saddle portion 80 carries a pair of outwardly curved projections serving as first and second auxiliary cam members or mechanical compression release and vacuum release cams 82, 84. At the ends of legs 74, 76 are respective counterweights 86, 88 which are shown extending along a line generally oblique to the axis of rotation of camshaft 30. Counterweights 86, 88 serve to bias the yoke member 72 by gravity, to the position shown in FIG. 4A, in which auxiliary cam members 82, 84 are in a valve unseating or "start" position corresponding to crankshaft 12 rotating at cranking speed.

Referring to FIG. 5, a pair of projections serving as stop members 90, 92 extend from inner portion 94 of saddle 80 and are radially and inwardly directed toward camshaft 30. At cranking speed, incidently concomitant with the start position illustrated in FIG. 4A, yoke member 72 pivots counterclockwise shown by arrow 96, coming to a rest when stop members 90, 92 contact peripheral surface 98 of camshaft 30. In this condition, during cranking of the engine, auxiliary cam members 82, 84 will engage the cam follower 38, first, during an early portion of the compression stroke, and second, during the latter portion of the power stroke to respectively release compression and vacuum formed in combustion chamber 20. Auxiliary cam members 82, 84 may be radially spaced apart corresponding to an angle of 90°, for example (FIG. 5).

It may be seen, with reference to FIG. 4A, that relatively flat underface 42 of cam follower 38 is displaced from its abutting relationship with surface 44 of cam lobe 34 due to first auxiliary cam or mechanical compression release cam 82 displacing cam follower 38 to correspondingly raise valve face 53 off seat 55 and vent combustion chamber 20. Thus, at low crankshaft speeds, auxiliary cam members 82, 84 assume their FIG. 4A position where they engage cam follower 38 to successively unseat valve 26 which releases compression during the compression stroke and vacuum during the power stroke.

Referring to FIG. 4B, illustrating camshaft 30 in the run position, centrifugal force acting through the center of mass of yoke member 72 causes yoke member 72 to pivot from its position of FIG. 4A to the position shown in FIG. 4B, in which arms 74, 76 are shown extending substantially perpendicularly to camshaft 30. Yoke member 72, pivoting about pin 78, and auxiliary cam members 82, 84 projecting from yoke member 72 swing away from cam follower 38 such that underface 42 of cam follower 38 and peripheral surface 44 of cam lobe 34 are in continuous abutting engagement with one another.

Compression and vacuum release mechanism 70 affects the lift of exhaust valve 26 relative to rotation of crankshaft 12 as hereinafter described. Referring to FIG. 1, a four-stroke cycle internal combustion engine 10 is shown and provides four strokes of piston 14 to complete a cycle of operation of the engine, coinciding with 720° of rotation of crankshaft 12. On the intake stroke, piston 14 moves downwardly from the top of its travel (referred to as top dead center or TDC) to the bottom of its travel (referred to as bottom dead center or BDC). Intake valve 21 (FIG. 2) is opened and exhaust valve 26 is closed during the intake stroke. During the intake stroke, and at crankshaft running speed, a charge of air/fuel mixture is drawn into cylinder 20 above the head of piston 14 and through intake valve 21. Following the intake stroke both intake and exhaust valves 21, 26 close and the compression stroke is started. Toward the middle of the compression stroke, approximately 110° of crankshaft rotation before TDC, for example, mechanical compression release cam 82 lifts exhaust valve 26 to relieve cylinder pressure and then closes at about 60° before TDC. Following the compression stroke, piston 14 is urged toward BDC in the power stroke, which coincides with both intake and exhaust valves 21, 26 substantially closed. At approximately 60° of crankshaft rotation following TDC during the power stroke, vacuum release cam 84 lifts exhaust valve 26 off of its seat and suction forces due to vacuum formed in cylinder 20 are relieved.

For instance, in an exemplary embodiment of the compression and vacuum release 70, intake valve 21 may have a lift of 0.2 inches during the intake stroke and exhaust valve 26 may be lifted 0.03 inches, and held open for 50° of camshaft rotation, by mechanical compression release cam 82 during the compression stroke. Specifically, the mechanical compression release opens the exhaust valve 26 at a crankshaft rotation of 110° prior to TDC and holds open exhaust valve 26 until crankshaft 12 is approximately 60° before TDC. The vacuum release activated by vacuum release cam 84 opens exhaust valve 26 a distance of 0.02 inches at a crankshaft rotation of 60° after TDC to vent suction caused by cylinder vacuum during the power stroke. Thus, the energy of the compressed air/fuel mixture is used to assist moving the piston during the power stroke. Cam 84 holds open exhaust valve 26 at 60° after TDC for a duration of 50° of crankshaft rotation.

Due to the balanced relationship provided to yoke member 38 through counterweights 86, 88 the counterweights may be seen to extend radially outwardly and reach an equilibrium position. When rotation of crankshaft 12 is slowed or stopped, the gravitational force will once again become dominant and yoke member 72 will pivot to its start position shown in FIG. 4A. While the drawings show the compression and vacuum release member 70 being biased to its start position solely by gravity, it is contemplated that in certain installations, the compression release member may be biased to its run position by a spring or other resilient member.

Figure 6:
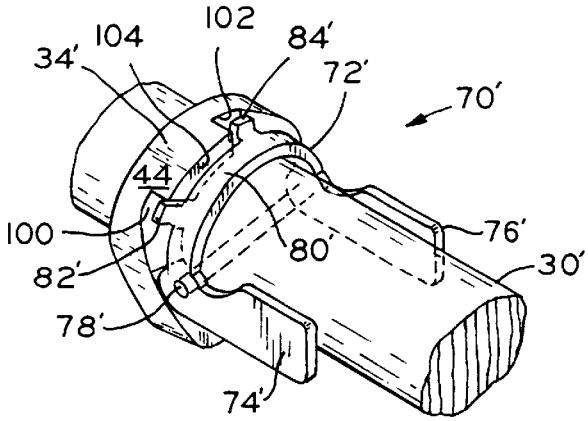
FIG. 6 is a perspective view of a second embodiment compression and vacuum assembly of the present invention engaged with a camshaft.
Figure 7A:
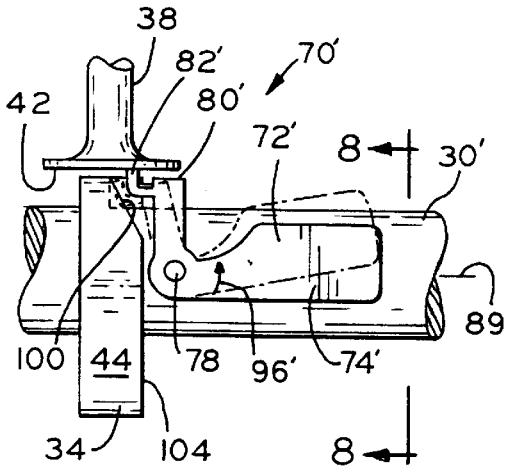
FIG. 7A is a side view of the compression and vacuum release assembly of FIG. 6, showing the assembly in the start position and showing the run position in phantom.
Figure 7B:
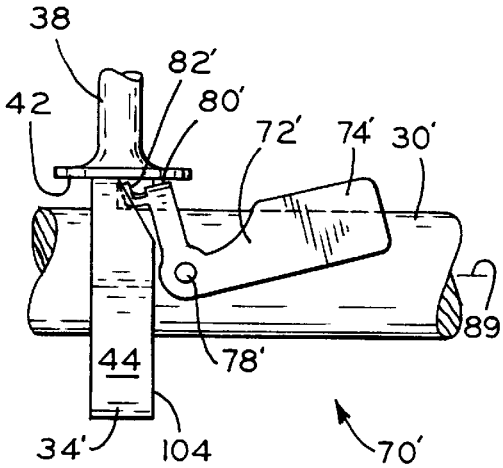
FIG. 7B is a side view of the compression and vacuum release assembly of FIG. 6, showing the assembly in the run position.
Figure 8:
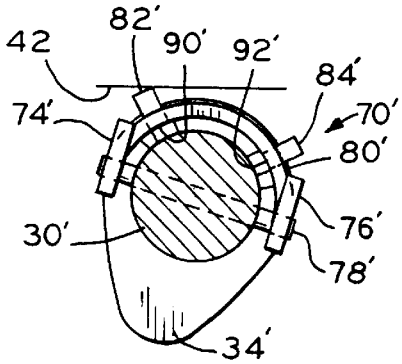
FIG. 8 is a sectional view of the view compression and vacuum release assembly of FIG. 6A taken along 8—8 of FIG. 6A.

Referring to FIGS. 6–8, shown is a second embodiment of a mechanical compression and vacuum release 70' of the present invention. Mechanical compression and vacuum release 70' differs from mechanical compression and vacuum release 70 in that release 70' includes auxiliary cams 82', 84' which pivot inwardly into recesses 100, 102 respectively provided in axial end 104 of exhaust cam lobe 34'.

Referring to FIG. 6, compression and vacuum release mechanism 70' includes pivotable yoke member 72', having a pair of legs 74', 76' that straddle camshaft 30'. Legs 74', 76' are pivotally connected to the camshaft by means of pin 78' and connected together by arcuate saddle portion 80' of yoke member 72'. Saddle portion 80' carries a pair of outwardly curved projections serving as first and second auxiliary cam members 82', 84'. Auxiliary cams 82', 84' may be radially spaced 90° apart, for example (FIG. 8). At the ends of legs 74', 76' are respective counterweights 86, 88 that extend along a line substantially parallel to the axis of rotation of camshaft 30'. Counterweights 86', 88' serve to bias the yoke member 72' by gravity, to the position shown in FIG. 7A, in which auxiliary cam members 82', 84' are in a valve unseating or "start" position.

Referring to FIG. 7A, yoke member 72' is urged into position by counterweights 86', 88' tending to pull respective legs 74', 76' inwardly toward and substantially parallel with axis of rotation 89 of cam 30'. Auxiliary cams 82', 84' are outwardly extended and correspondingly unseat underface 42 of cam follower 38 from cam lobe 34'. In this condition, during cranking of the engine, mechanical compression release and vacuum release cams 82', 84' will successively engage cam follower 38', first, during the compression stroke, and second, during the power stroke to respectively release compression and vacuum formed in combustion chamber 20. It may be seen, with reference to FIG. 7A, that cam follower underface 42 of cam follower 38 is displaced from its abutting relationship with surface 44' of cam lobe 34' due to mechanical compression release cam 82' displacing cam follower 38' to correspondingly raise valve face 53 off seat 55 and vent compression chamber 20. Thus, at low crankshaft speeds, cam members 82', 84' assume their FIG. 7A position where they engage cam follower 38 to unseat valve 26 which releases compression during the compression stroke and vacuum during the power stroke.

Referring to FIG. 7B, illustrating camshaft 30' the run position, centrifugal force acting through the center of mass causes yoke member 72' to pivot from its position of FIG. 7A to the yoke member position shown in FIG. 7B. Yoke member 72', pivoting about pin 78', and auxiliary cam members 82', 84' projecting from yoke member 72' swing away from cam follower 38 such that underface 42 of cam follower 38 and peripheral surface 44' of cam lobe 34' are in continuous abutting engagement with one another.

Referring again to FIG. 7B, recesses 100, 102 formed in axial end 104 of camshaft lobe 34' provide respective stops for auxiliary cams 82', 84' in the run position. Specifically, auxiliary cams 82', 84' are urged to recede under the peripheral surface 44' of cam lobe 34' and auxiliary cams 82', 84' are in abutment with respective recesses 100, 102. When rotation of crankshaft 12 is slowed or stopped, the gravitational force will once again become dominant and yoke member 72' will pivot to its start position shown in FIG. 7A. While the drawings show the compression and vacuum release member 70' being biased to its start position solely by gravity, it is contemplated that in certain installations, the compression release member may be biased to its run position by a spring or other resilient member.

Further, it is envisioned that the mechanical compression release, provided by mechanical compression release cams 82, 82', and the vacuum release, provided by vacuum release cams 84, 84' may be structured and arranged to engage the respective exhaust and intake valves independently of one another. This may be accomplished by providing two yokes, each yoke possessing only a single auxiliary cam, rather than a pair of auxiliary cams. Each yoke is pivotably and independently supported by the camshaft, one having mechanical compression release cam 82 or 82' to relieve compression in the cylinder and the other yoke including vacuum release cam 84 or 84' to relieve vacuum in the cylinder.

The disclosed embodiments are not intended to be exhaustive or limit the invention to the precise forms disclosed in the detailed description. While the present invention has been described as having exemplary designs, the present invention can be further modified within the spirit and scope of this disclosure. Further, this application is intended to cover such departures from the present disclosure as come within known or customary practice in the art to which this invention pertains.

What is claimed is:

1. An internal combustion engine, comprising:

a cylinder block including a cylinder therein and having a piston reciprocally disposed within said cylinder, said piston operably engaged with a crankshaft;

a camshaft in timed driven relationship with said crankshaft;

at least one intake valve assembly reciprocally driven by said camshaft;

at least one exhaust valve assembly reciprocally driven by said camshaft;

a vacuum release mechanism, comprising:

a vacuum release member attached to said camshaft and centrifugally moveable between first and second positions, said vacuum release member including a vacuum release cam extending therefrom, said vacuum release cam in lifting engagement with one of said valve assemblies in said first position during at least a portion of a power stroke of said piston to relieve vacuum forces opposing said power stroke, said vacuum release cam disposed out of engagement with said one of said valve assemblies in said second position.

2. The internal combustion engine in claim 1, wherein said vacuum release member additionally includes a compression release cam extending therefrom, said compression release cam in lifting engagement with one of said valve assemblies in said first position during at least a portion of a compression stroke of said piston to relieve compression forces opposing said compression stroke, said compression release cam disposed out of engagement with said one of said valve assemblies in said second position.

3. The internal combustion engine of claim 1, wherein said vacuum release member comprises a yoke member pivotally attached to said camshaft, said yoke member pivotable about an axis extending substantially transverse to said camshaft.

4. The internal combustion engine of claim 3, wherein said pivot axis comprises a pivot pin extending through said camshaft and attached to said vacuum release member.

5. The internal combustion engine of claim 3, wherein said yoke member includes a pair of arms disposed on opposite sides of said camshaft, said arms connected to a central portion from which said vacuum release cam extends.

6. The internal combustion engine of claim 5, wherein said pair of arms extend obliquely to said camshaft in said first position, and extend substantially perpendicularly to said camshaft in said second position.

7. The internal combustion engine of claim 5, wherein said pair of arms extend substantially parallel to said camshaft in said first position, and extend obliquely to said camshaft in said second position.

8. The internal combustion engine of claim 1, wherein said camshaft includes a cam lobe reciprocally driving said exhaust valve assembly, said cam lobe including a recess therein into which said vacuum release cam is disposed in said second position.

9. An internal combustion engine, comprising:

a cylinder block including a cylinder therein and having a piston reciprocally disposed within said cylinder, said piston operably engaged with a crankshaft;

a camshaft in timed driven relationship with said crankshaft;

at least one intake valve assembly reciprocally driven by said camshaft;

at least one exhaust valve assembly reciprocally driven by said camshaft; and a compression and vacuum release mechanism, comprising:

a compression and vacuum release member attached to said camshaft and centrifugally moveable between first and second positions, said compression and vacuum release member including a compression release cam and a vacuum release cam extending therefrom, said compression and vacuum release cams respectively in lifting engagement with one of said valve assemblies in said first position during a portion of a compression and a portion of a power stroke of said piston to relieve compression and vacuum forces respectively opposing said compression and said power strokes, said compression and vacuum release cams disposed out of engagement with said one of said valve assemblies in said second position.

10. The internal combustion engine of claim 9, wherein said compression and vacuum release member is pivotally attached to said camshaft about an axis extending substantially transverse to said camshaft.

11. The internal combustion engine of claim 10, wherein said pivot axis comprises a pivot pin extending through said camshaft and attached to said compression and vacuum release member.

12. The internal combustion engine of claim 9, wherein said compression and vacuum release member comprises a yoke member including a pair of arms disposed on opposite sides of said camshaft, said arms connected to a central portion from which said compression and vacuum release cams extend.

13. The internal combustion engine of claim 9, wherein said camshaft includes a cam lobe reciprocatingly driving said exhaust valve assembly, said cam lobe including a pair of recesses therein into which said compression and vacuum release cams are respectively disposed in said second position.

14. The internal combustion engine of claim 12, wherein said pair of arms extend substantially oblique to said camshaft in said first position, and extend substantially perpendicular to said camshaft in said second position.

15. The internal combustion engine of claim 12, wherein said pair of arms extend substantially parallel to said camshaft in said first position, and extend substantially oblique to said camshaft in said second position.

16. An internal combustion engine, comprising:

a cylinder block including a cylinder therein and having a piston reciprocally disposed within said cylinder, said piston operably engaged with a crankshaft;

a camshaft in timed driven relationship with said crankshaft;

at least one intake valve assembly reciprocally driven by said camshaft;

at least one exhaust valve assembly reciprocally driven by said camshaft; and a compression and vacuum release mechanism, comprising:

a centrifugally actuated common yoke member moveably attached to said camshaft between a first position corresponding to a cranking speed of said engine and a second position corresponding to a running speed of said engine;

a compression release cam extending from said yoke member and in lifting engagement with one of said valve assemblies in said second position during a portion of a compression stroke of said piston to relieve compressive forces opposing said compression stroke; and a vacuum release cam extending from said yoke member and in lifting engagement with said one of said valve assemblies in said first position during a portion of a power stroke of said piston to relieve vacuum forces opposing said power stroke;

said compression and vacuum release cams disposed out of lifting engagement with said one of said valve assemblies in said second position.

17. The internal combustion engine of claim 16, wherein said yoke member is pivotally mounted to said camshaft by a pivot pin extending substantially transversely through said camshaft.

18. The internal combustion engine of claim 16, wherein said yoke member includes a pair of flyweights disposed on opposite sides of said camshaft, said flyweights connected to a central portion from which said compression and vacuum release cams extend.

19. The internal combustion engine of claim 18, wherein said pair of flyweights extend obliquely to said camshaft in said first position, and extend substantially perpendicularly to said camshaft in said second position.

20. The internal combustion engine of claim 18, wherein said pair of flyweights extend substantially parallel to said camshaft in said first position, and extend substantially obliquely to said camshaft in said second position.

21. The internal combustion engine of claim 16, wherein said camshaft includes a cam lobe reciprocatingly driving said exhaust valve assembly, said cam lobe including a pair of recesses therein into which said compression and vacuum release cams are respectively disposed in said second position.

* * * * *